US011259576B1

(12) United States Patent
Campbell

(10) Patent No.: US 11,259,576 B1
(45) Date of Patent: Mar. 1, 2022

(54) ILLUMINATED HIGH-VISIBILITY SAFETY VEST

(71) Applicant: Donald Nicholas Campbell, Cleves, OH (US)

(72) Inventor: Donald Nicholas Campbell, Cleves, OH (US)

( * ) Notice: Subject to any disclaimer, the term of this patent is extended or adjusted under 35 U.S.C. 154(b) by 0 days.

(21) Appl. No.: 17/099,926

(22) Filed: Nov. 17, 2020

Related U.S. Application Data

(60) Provisional application No. 62/944,610, filed on Dec. 6, 2019.

(51) Int. Cl.

| | |
|---|---|
| ***A41D 13/01*** | (2006.01) |
| ***A41D 1/04*** | (2006.01) |
| ***G09F 9/33*** | (2006.01) |
| ***G08B 5/38*** | (2006.01) |
| ***G08B 5/00*** | (2006.01) |

(52) U.S. Cl.
CPC ..... *A41D 13/01* (2013.01); *A41D 1/04* (2013.01); *G08B 5/004* (2013.01); *G08B 5/38* (2013.01); *G09F 9/33* (2013.01)

(58) Field of Classification Search
CPC ..... A41D 13/01; A41D 1/04; G08B 5/004; G08B 5/38; G09F 9/33
See application file for complete search history.

(56) References Cited

U.S. PATENT DOCUMENTS

| | | | | |
|---|---|---|---|---|
| 6,267,482 | B1 * | 7/2001 | Miller | A41D 13/01 362/103 |
| 10,856,589 | B1 * | 12/2020 | Lee | A41D 27/20 |
| 2007/0199128 | A1 * | 8/2007 | Golle | A41D 13/01 2/69 |
| 2010/0315252 | A1 * | 12/2010 | Desphande | F21S 8/088 340/670 |
| 2011/0235311 | A1 * | 9/2011 | Stone | A42B 3/044 362/106 |
| 2012/0033411 | A1 * | 2/2012 | Heo | G08B 5/004 362/108 |
| 2015/0062892 | A1 * | 3/2015 | Krames | H05B 45/20 362/231 |
| 2016/0091183 | A1 * | 3/2016 | Leonard | G08B 5/004 362/190 |
| 2021/0068477 | A1 * | 3/2021 | Johnson | A41D 1/002 |

* cited by examiner

*Primary Examiner* — Alan B Cariaso
(74) *Attorney, Agent, or Firm* — Ulmer & Berne LLP

(57) ABSTRACT

A high visibility safety vest assembly includes first and second elongated illumination assemblies positioned on a front portion of a vest, and third and fourth elongated illumination assemblies positioned on a rear portion of the vest. The vest includes a material layer. A high visibility safety vest assembly also includes a power supply having a rechargeable battery and supported by the vest. A control device is electrically coupled with the power supply and each of the first, second, third and fourth elongated illumination assemblies. The control device is configured to selectively facilitate provision of electrical power from the power supply to the first, second, third and fourth elongated illumination assemblies. The first, second, third and fourth elongated illumination assemblies are positioned such that, when the vest is donned by a person standing upright, each of the first, second, third and fourth elongated illumination assemblies are generally vertically oriented.

20 Claims, 14 Drawing Sheets

ILLUMINATED HIGH-VISIBILITY SAFETY VEST

REFERENCE TO RELATED APPLICATION

This application claims priority of U.S. provisional patent application Ser. No. 62/944,610, filed Dec. 6, 2019, and hereby incorporates this provisional patent application by reference herein in its entirety.

TECHNICAL FIELD

The present disclosure relates to safety vests and, more particularly, the present disclosure relates to safety vests that include high-intensity powered illumination features.

BACKGROUND

Brightly colored vests are commonly worn by police officers, traffic officers, construction workers, and other personnel seeking to enhance their visibility when working in close proximity to vehicular traffic or other areas in which visibility is desired. These vests are often worn over garments and are conventionally made in high-visibility colors such as neon orange, yellow, or green. To increase visibility, these vests often include reflective features to reflect the light from vehicle headlights. Even though these high-visibility safety vests improve the chances that a wearer of the vest will be seen by others, certain limitations still exist. First, the ability for a colored vest to distinguish a wearer from the surrounding environment greatly diminishes as the ambient light diminishes. Second, while police officers and other safety personnel may don safety vests while operating on scene, this personnel is frequently operating proximate to one or more vehicles having high-intensity light bars, flashing lights, strobe lights, and an array of other types of emergency lighting, all of which are specifically designed to catch the attention of oncoming motorists. Due to the volume and intensity of this vehicle emergency lighting, oncoming motorists may not be able to discern a police officer or other safety personnel operating on the scene, especially in conditions with low ambient lighting or otherwise poor visibility. Accordingly, despite wearing brightly colored and/or reflective safety vests, the safety personnel may not be readily visible to oncoming traffic.

As such, there remains a need to provide safety vests that provide visibility to a wearer in low ambient lighting conditions and also provide visibility when worn by personnel operating near vehicles that have high-intensity emergency lighting, such as a police vehicles, firefighting apparatus, ambulances, tow trucks, and other types of safety and utility vehicles.

SUMMARY

A high visibility safety vest assembly includes first and second elongated illumination assemblies positioned on a front portion of a vest, and third and fourth elongated illumination assemblies positioned on a rear portion of the vest. The vest includes a material layer. A high visibility safety vest assembly also includes a power supply having a rechargeable battery and supported by the vest. A control device is electrically coupled with the power supply and each of the first, second, third and fourth elongated illumination assemblies. The control device is configured to selectively facilitate provision of electrical power from the power supply to the first, second, third and fourth elongated illumination assemblies. The first, second, third and fourth elongated illumination assemblies are positioned such that, when the vest is donned by a person standing upright, each of the first, second, third and fourth elongated illumination assemblies are generally vertically oriented.

DETAILED DESCRIPTION

Various non-limiting embodiments of the present disclosure are described herein to provide an overall understanding of the principles of the structure, function, and use of safety vests having high-intensity powered illumination features. Those of ordinary skill in the art will understand that apparatuses and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

Figure 1:
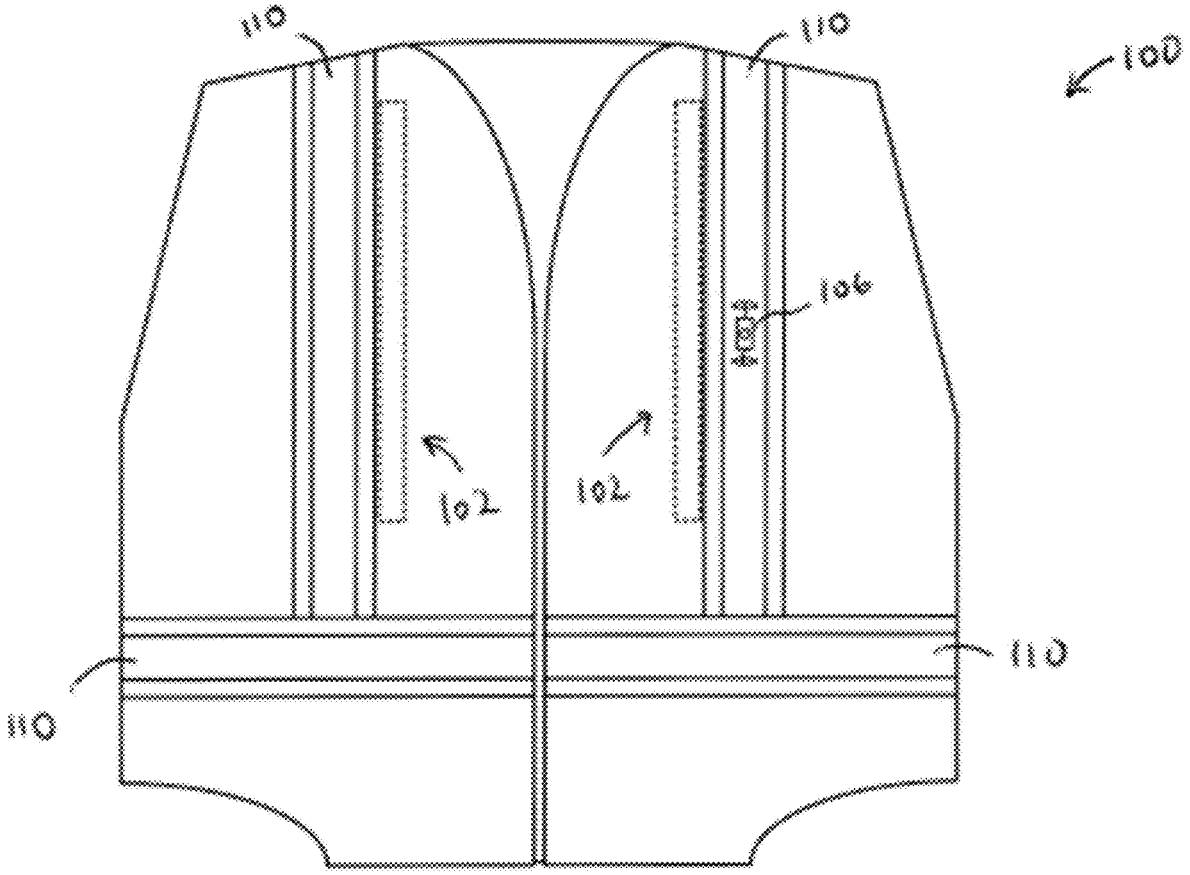
FIG. 1 is a front view of an example safety vest having elongated illumination assemblies in accordance with one non-limiting embodiment.
Figure 2:
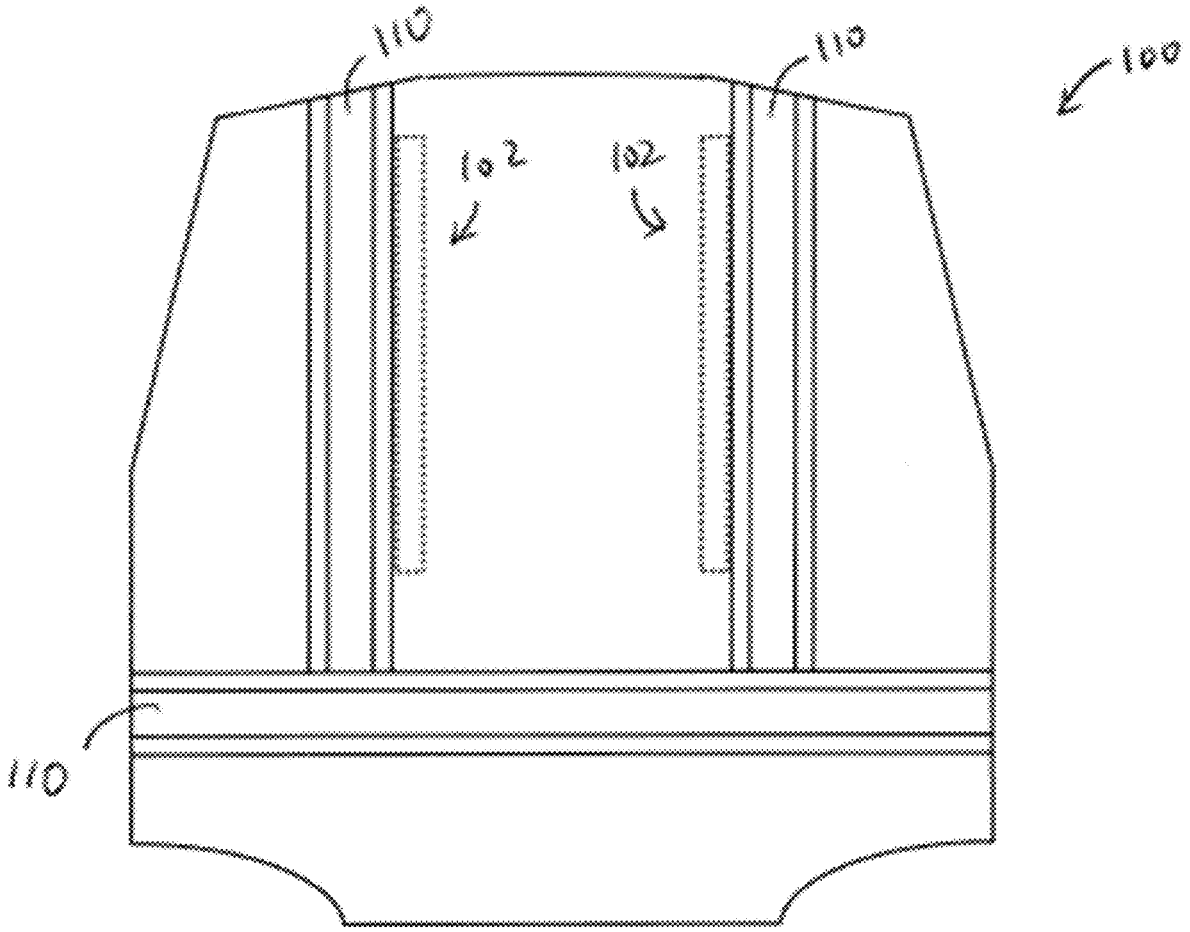
FIG. 2 is a rear view of the safety vest of FIG. 1.
Figure 3:
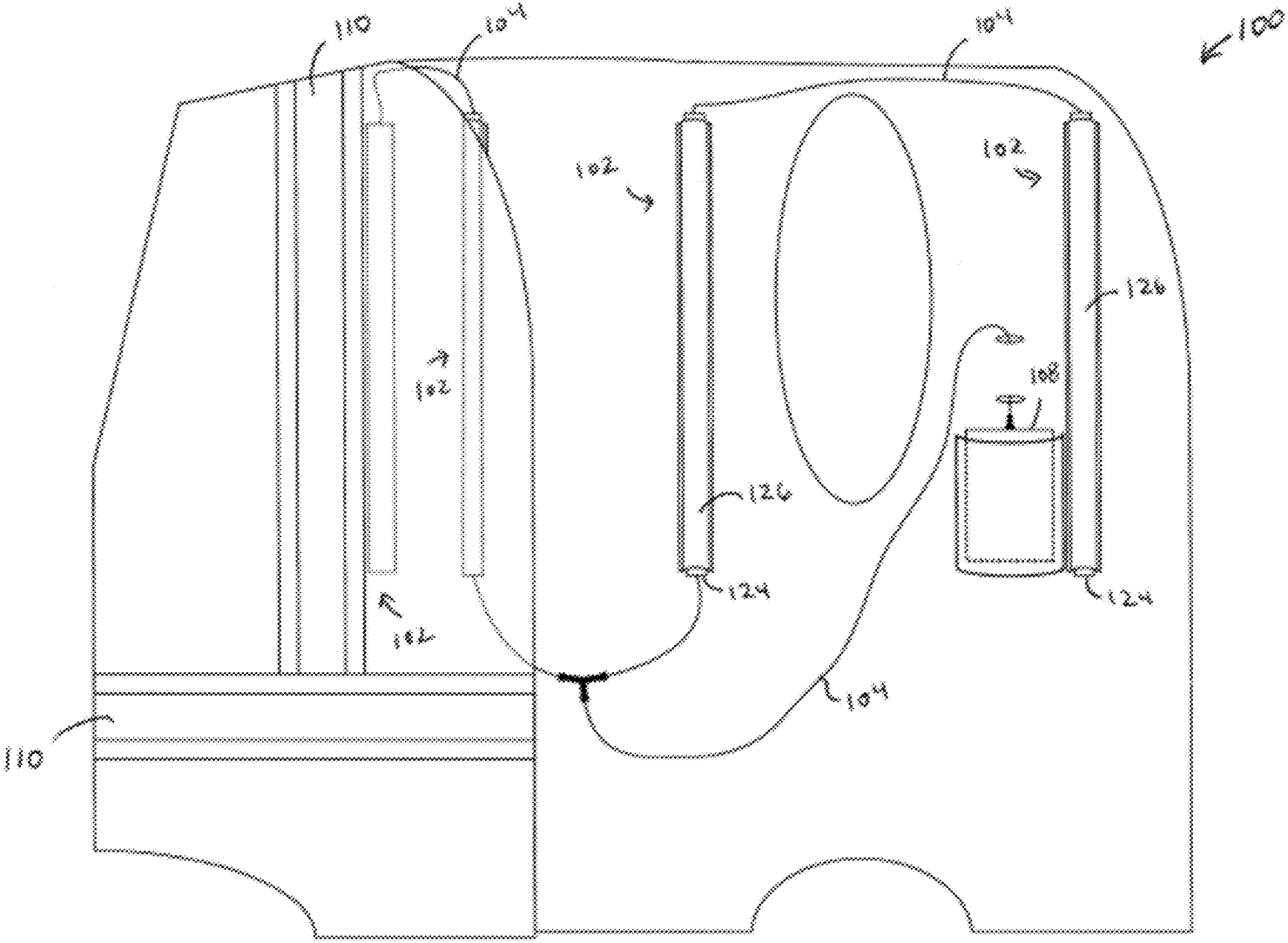
FIG. 3 shows the safety vest of FIG. 1 in a partially opened configuration.

FIGS. 1-3 schematically depict a high-visibility safety vest 100 in accordance with one non-limiting embodiment. FIG. 1 is a front view of the safety vest 100 and FIG. 2 is a rear view of the safety vest 100. FIG. 3 shows the safety vest 100 in a partially opened configuration. The safety vest 100 can include a plurality of elongated illumination assemblies 102. In the illustrated embodiment, each of the elongated illumination assemblies 102 are positioned such that they are generally vertically oriented when the safety vest 100 is donned by a wearer. As shown in FIG. 1, two elongated illumination assemblies 102 can be positioned on a front portion of the safety vest 100. As shown in FIG. 2, two elongated illumination assemblies 102 can be positioned on a rear portion of the safety vest 100. In other embodiments, other configurations of elongated illumination assemblies 102 can be utilized. The safety vest 100 can also include reflective portions 110, such as reflective tape, or other features to comply with various safety standards. In some embodiments, the elongated illumination assemblies 102 can be positioned on the safety vest 100 such that they are generally parallel to the reflective portions 110.

Figure 14A:
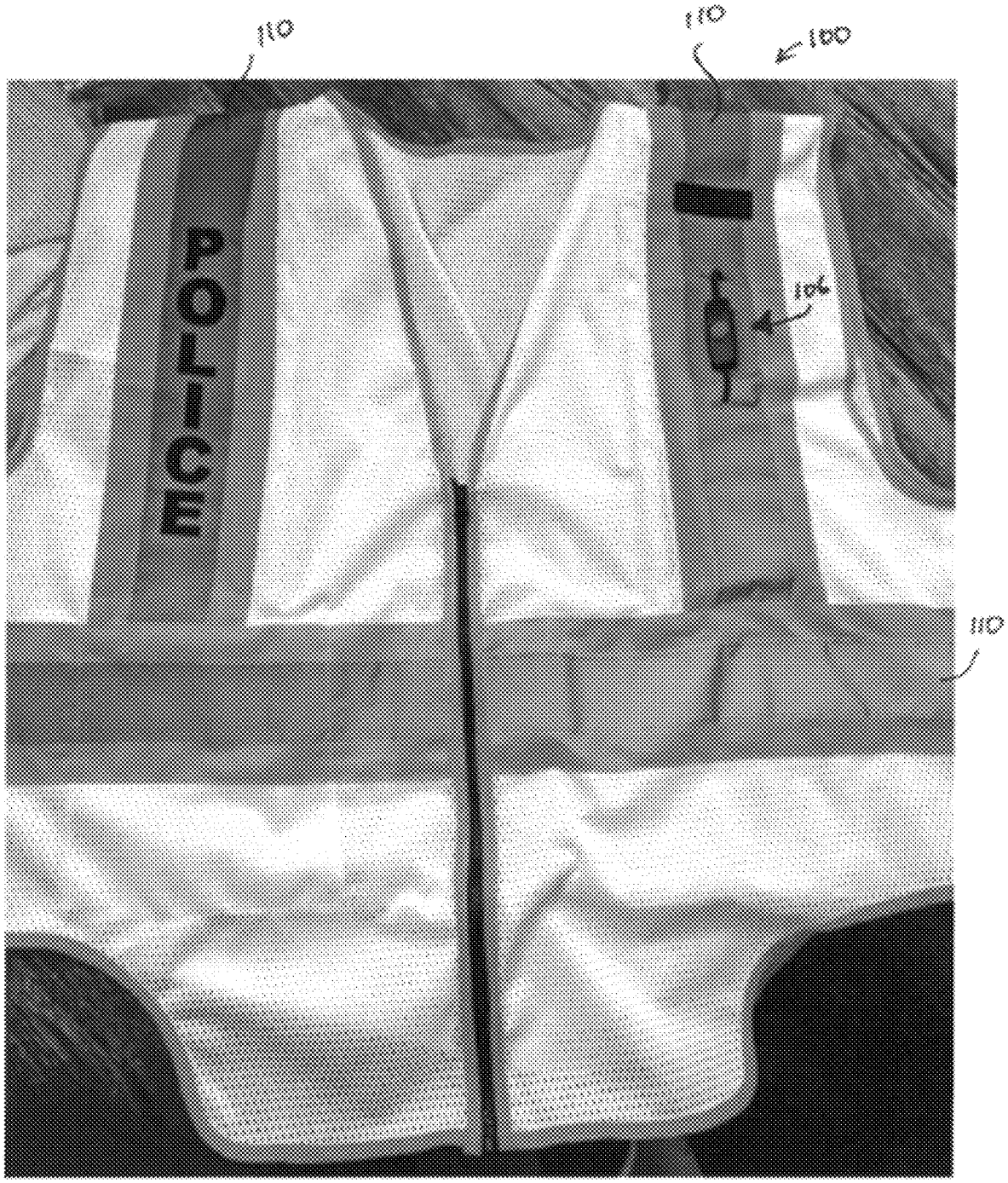
FIGS. 14A-14B depict an example safety vest having illuminated elongated illumination assemblies in a non-powered state (FIG. 14A) and a powered state (FIG. 14B).
Figure 14B:
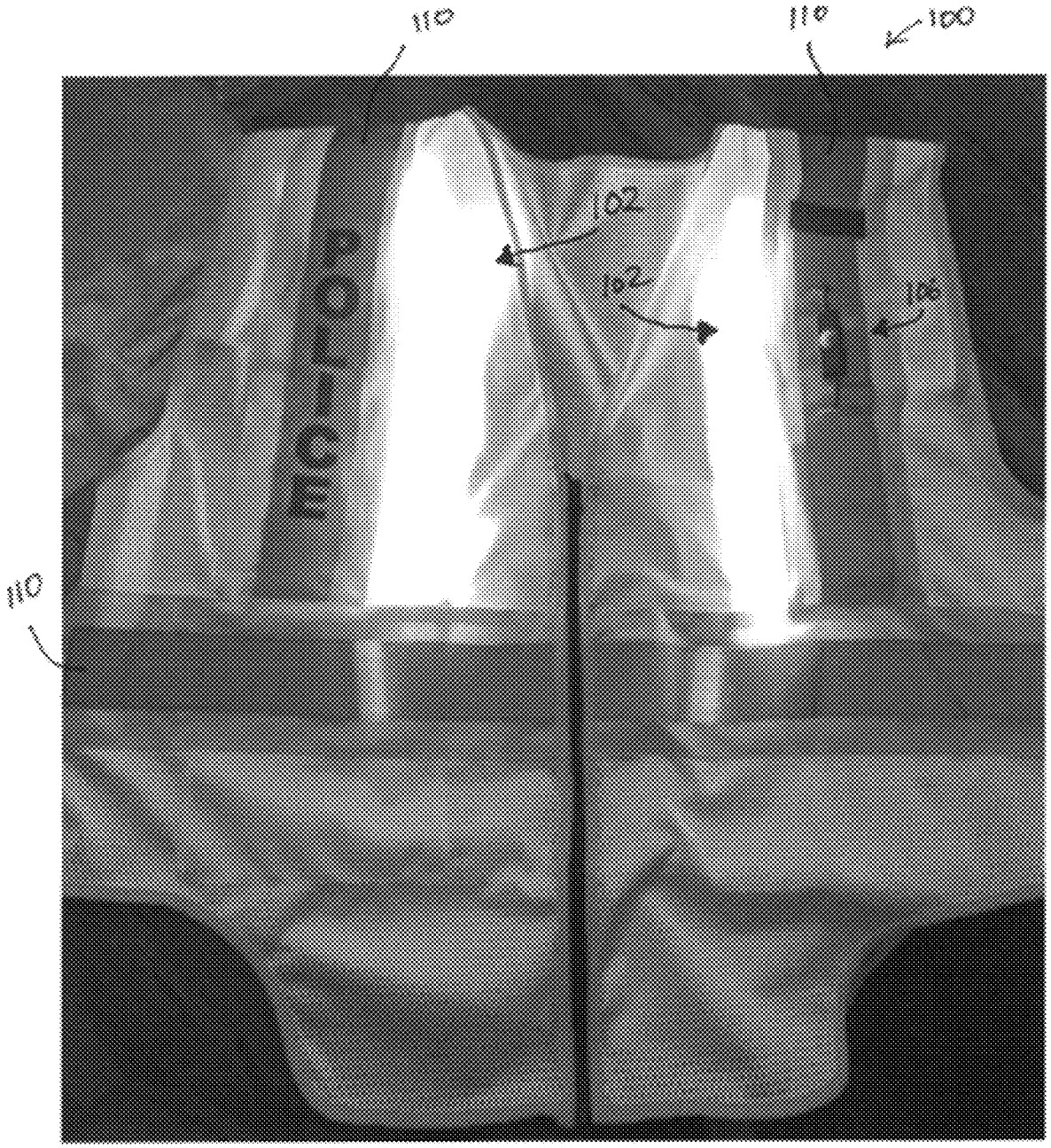

The elongated illumination assemblies 102 can be mounted to an inside surface of the safety vest 100, as illustrated in FIG. 3, with the high-intensity illumination generated by the elongated illumination assemblies 102 being viewable through the material layer of the safety vest 100. In this regard, the color of the material layer of the safety vest 100 can cause the illumination provided by the elongated illumination assemblies 102 to be colored, thereby increasing visibility. For example, in some embodiments, the portion of the safety vest 100 at which the elongated illumination assemblies 102 is positioned is neon green, such that illumination of the elongated illumination assemblies 102 provides a green hue to observers. An example of a safety vest having a green hue is shown in FIGS. 14A-14B.

Figure 5:
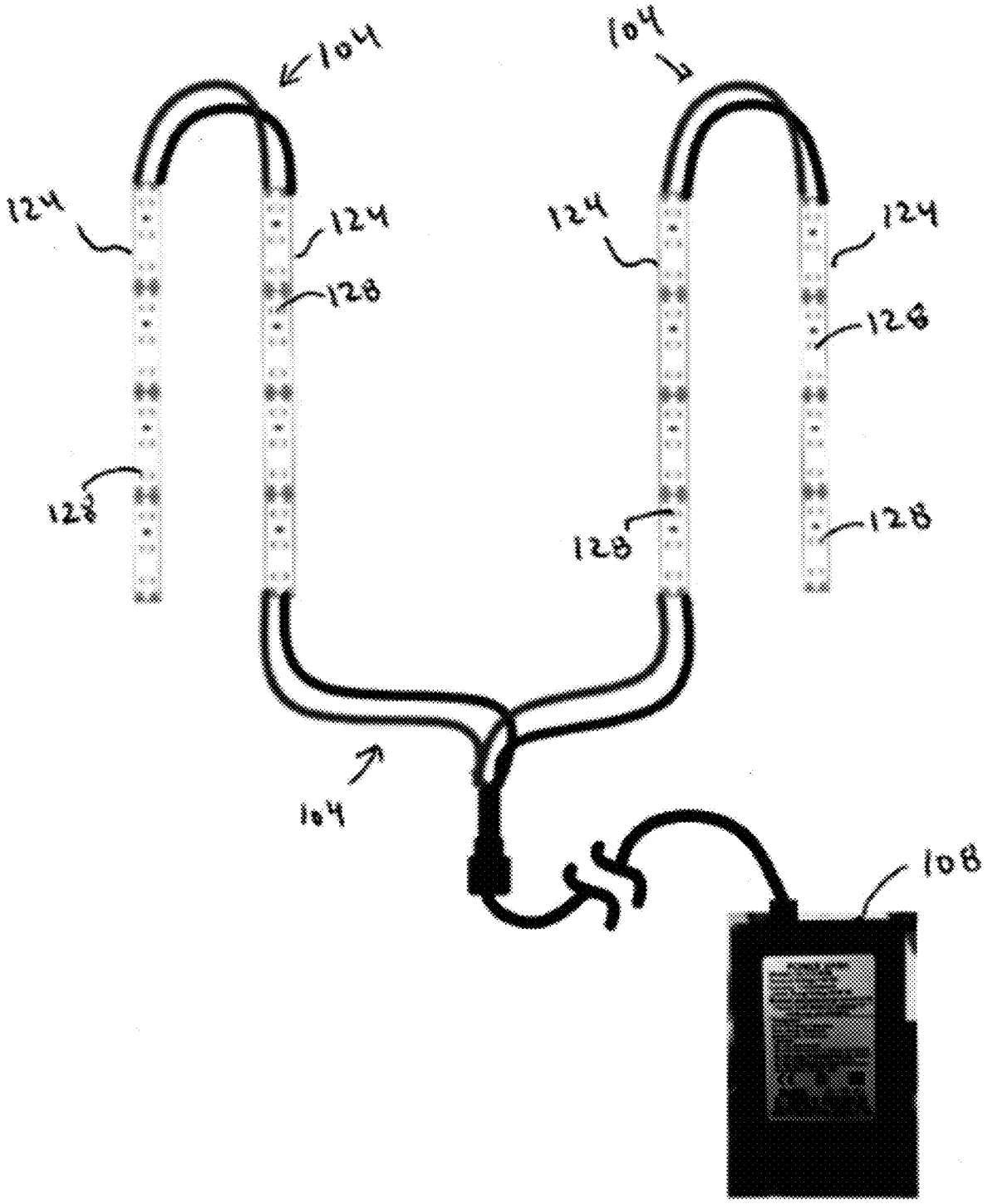
FIG. 5 schematically depicts an example wiring diagram of a safety vest in accordance with one non-limiting embodiment.
Figure 7:
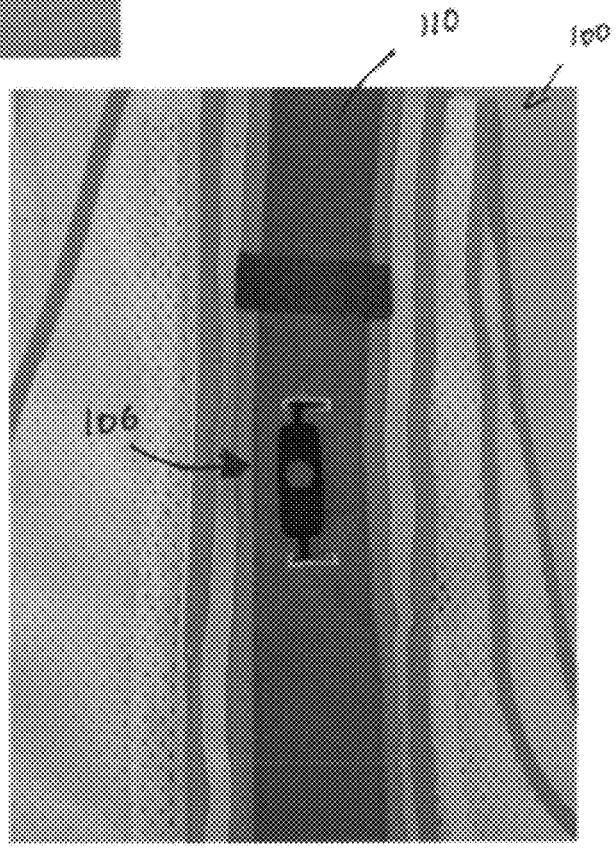

Still referring to FIG. 3, various conductors 104 can be used to electrically connect each of the elongated illumination assemblies 102 to a power supply 108. The power supply 108 can be a rechargeable power supply that provides 12 VDC, or other suitable voltage level, to the elongated illumination assemblies 102. In some embodiments, the power supply 108 can illuminate the elongated illumination assemblies 102 for approximately 2.5 hours on a single charge and can re-charge in about 1 hour. The power supply 108 can be stored in an inside pocket of the safety vest 100, for example. For safety vests having larger power supplies, the power supply can be positioned in a pocket position in the rear of the vest. FIG. 5 schematically depicts an example wiring diagram in accordance with one non-limiting embodiment. As shown in FIG. 1, a power switch 106 can also be provided to allow a user to selectively turn the elongated illumination assemblies 102 on and off. FIG. 7 is a photograph of an example power switch 106 that is mounted proximate to the reflective portions 110 of the safety vest 100. It is to be appreciated that the power switch 106 can be provided in a variety of different suitable locations. Further, in some embodiments, the power switch 106 can also allow the wearer to select different settings, such as a high/low setting, a flashing setting, and so forth.

In a further embodiment, the power switch can comprise a dimmer switch configured facilitate a wearer's selective adjustment of intensity of light emitted from the elongated illumination assemblies of the safety vest, either from a plurality of preset selectable intensities or variably from a low intensity setting to a high intensity setting. It will be appreciated that a low intensity setting may be advantageously used to conserve battery life, such as to achieve a battery longevity of about 2 times to about 4 times that achievable during a high intensity setting. For example, in one embodiment, a battery might allow for about 3 hours of continuous use at a high or full intensity setting, while allowing for about 8 hours of continuous use (e.g., a full working shift) at a low intensity setting. Additionally, it will be appreciated that lower intensity settings may be preferable for use in certain environments and/or situations, e.g., in very low light conditions and/or to avoid blinding of another person in close proximity with the wearer. Any of a variety of dimmer types can be employed such as, for example, involving variable resistance, variable voltage, and/or pulse width modulation.

In still further embodiments, it will be appreciated that the power switch can facilitate selective operation and disablement of respective ones of the elongated illumination assemblies. For example, in a first setting, the power switch can be configured to allow a wearer to facilitate illumination of the elongated illumination assemblies positioned on the front portion of the safety vest, but to prevent illumination of the elongated illumination assemblies positioned on the rear portion of the safety vest. In this same example, in a second setting, the power switch can be configured to allow a wearer to facilitate illumination of the elongated illumination assemblies positioned on the rear portion of the safety vest, but to prevent illumination of the elongated illumination assemblies positioned on the front portion of the safety vest. In a similar manner, the power switch can be configured to facilitate differential control of elongated illumination assemblies positioned on left versus right sides of the vest. It will be appreciated that, in some embodiments, the power switch can simultaneously facilitate different intensities and/or patterns (steady versus flashing) among various ones of the elongated illumination assemblies of a safety vest.

Figure 4:
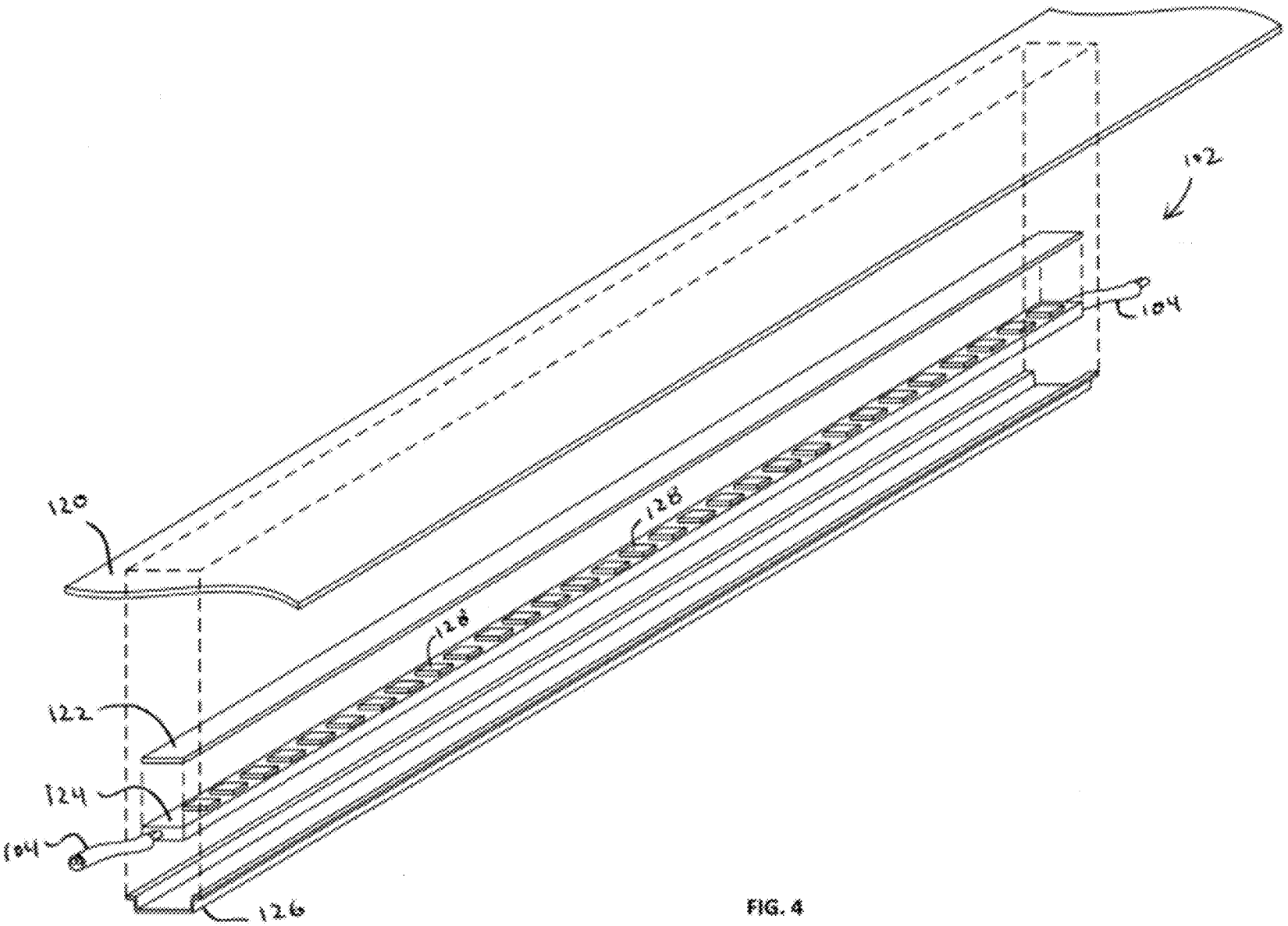
FIG. 4 is an exploded view of an example elongated illumination assembly in accordance with one non-limiting embodiment.
Figure 8A:
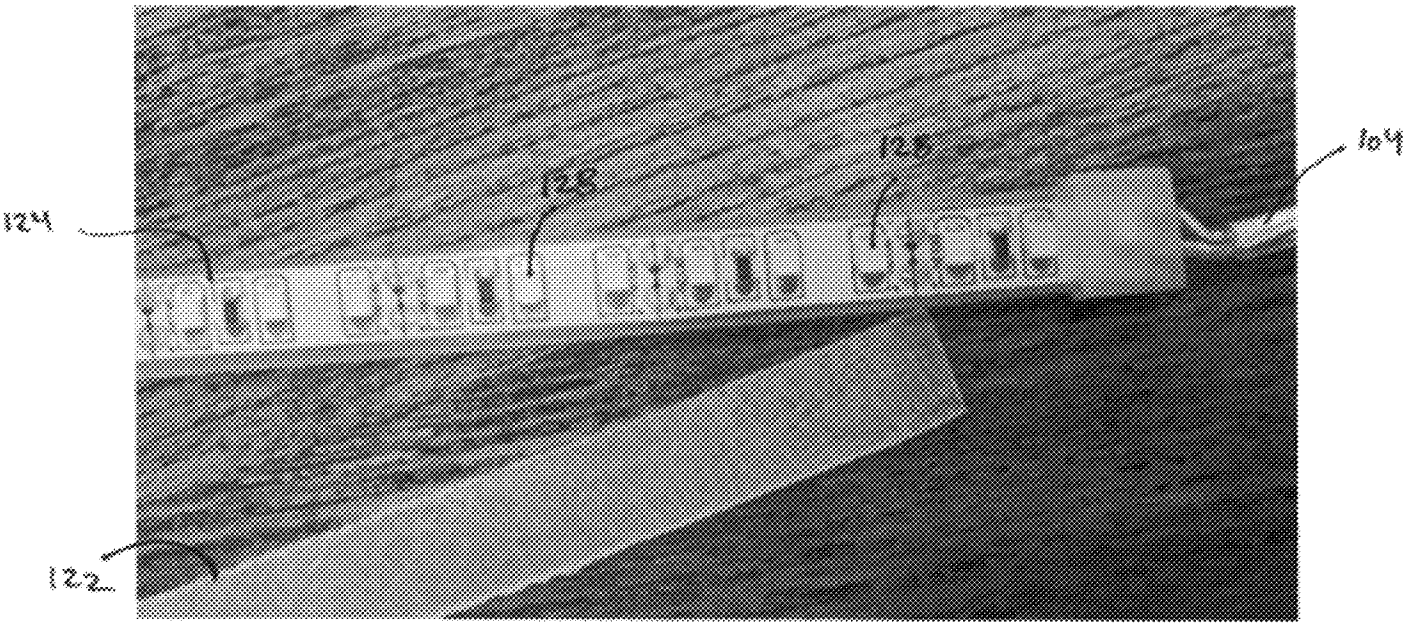
FIGS. 8A-8B depict an example lighting strip and diffuser in accordance with one non-limiting embodiment.
Figure 8B:
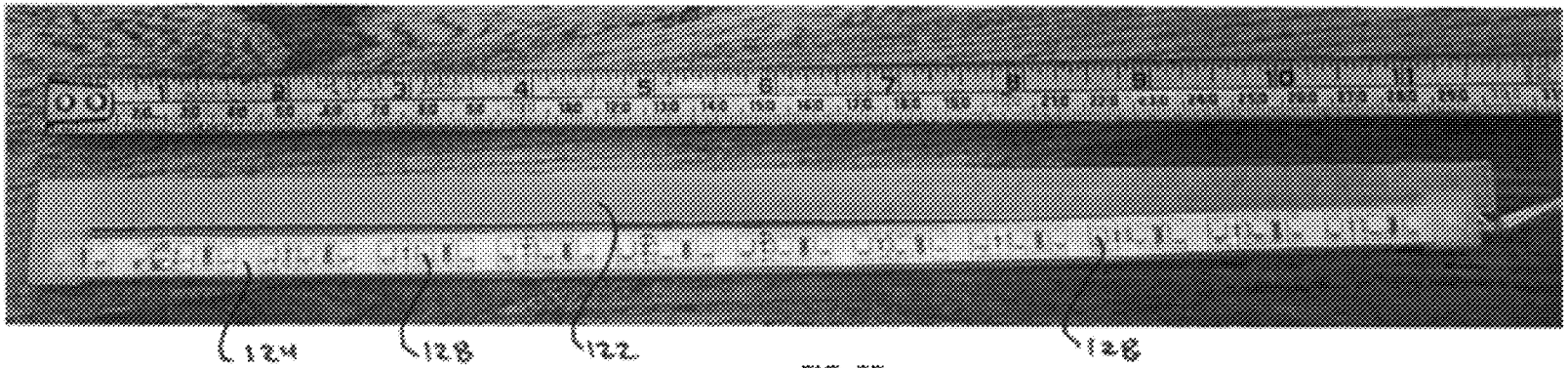

FIG. 4 is an exploded view of an example elongated illumination assembly 102 that can be attached to an inside surface of a material layer 120 of the safety vest 100 (FIG. 1). The material layer 120 can be a polyester mesh, for example. The elongated illumination assembly 102 can include a diffuser 122 that is used to diffuse the light generated by light emitting diodes (LEDs) 128 that are mounted to a lighting strip 124. FIGS. 8A-8B are photographs of an example diffuser 122 and a lighting strip 124 that includes a plurality of surface mount LEDs 128. While various types of LEDs 128 can be used, in some embodiments, the LEDs 128 are ultra-bright, high-intensity LEDs that have a light efficiency of 120-130 lm/w, a color temperature of 6500K, and a working voltage of 12 VDC. In one embodiment, the lighting strip 124 is about 11.5 inches in length, about $3/8^{th}$ inch in width and has more than 30 LEDs 128 mounted thereto. In one embodiment, the lighting strip 124 has a total of 36 LEDs 128 that are linearly spaced along the lighting strip 124. The LEDs 128 can be generally evenly spaced along the lighting strip 124. In some embodiments, each LED 128 is spaced less than ½ inch from its adjacent LED 128. In some embodiments, each LED 128 is spaced less than ⅜ inch from its adjacent LED 128. The number of LEDs 128 and the close spacing of the LEDs 128 helps to create a solid bar of continuous light to an observer when the LEDs 128 are illuminated (as shown in FIG. 14B, for example). The diffuser 122 can have a width that is generally similar to the width of the lighting strip 124. In some embodiments, the width of the diffuser 122 is slightly greater than the width of lighting strip 124. For instance, the width of the lighting strip 124 can be about 5/16 inch and the width of the diffuser 122 can be about ⅜ inch. Further, the length of the diffuser 122 can be generally similar to the length of the lighting strip 124. By way of example, the diffuser 122 in FIG. 8B has a length of about 11⅝ inches. The diffuser 122 can be any suitable material, such a polycarbonate, which can blend the light generated from each of the LEDs 128 to create the desired glow.

Figure 6:
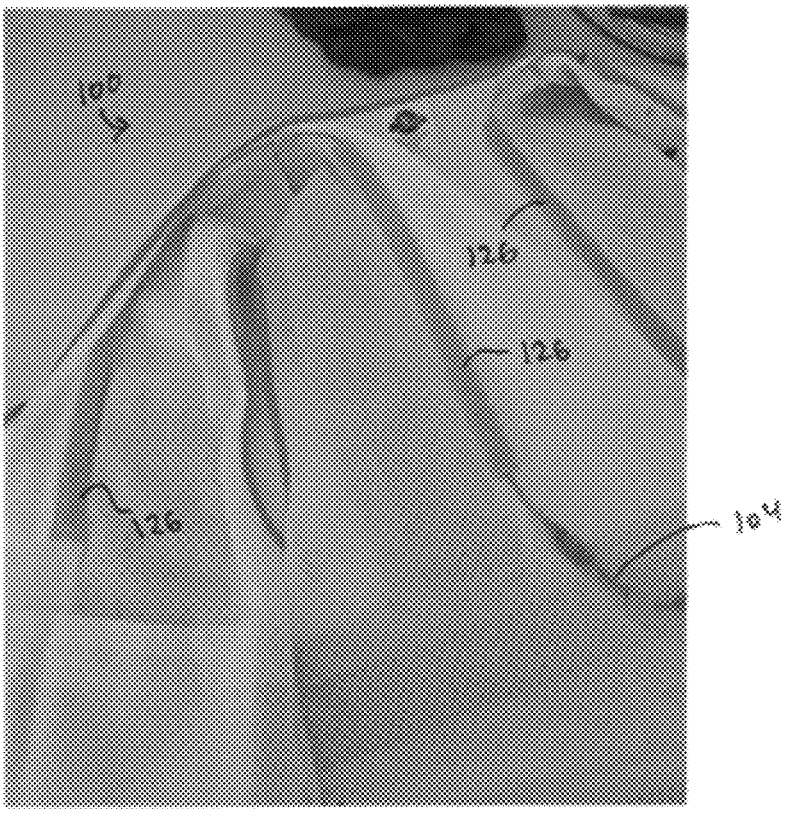
FIGS. 6-7 depict an example safety vest.
Figure 10:
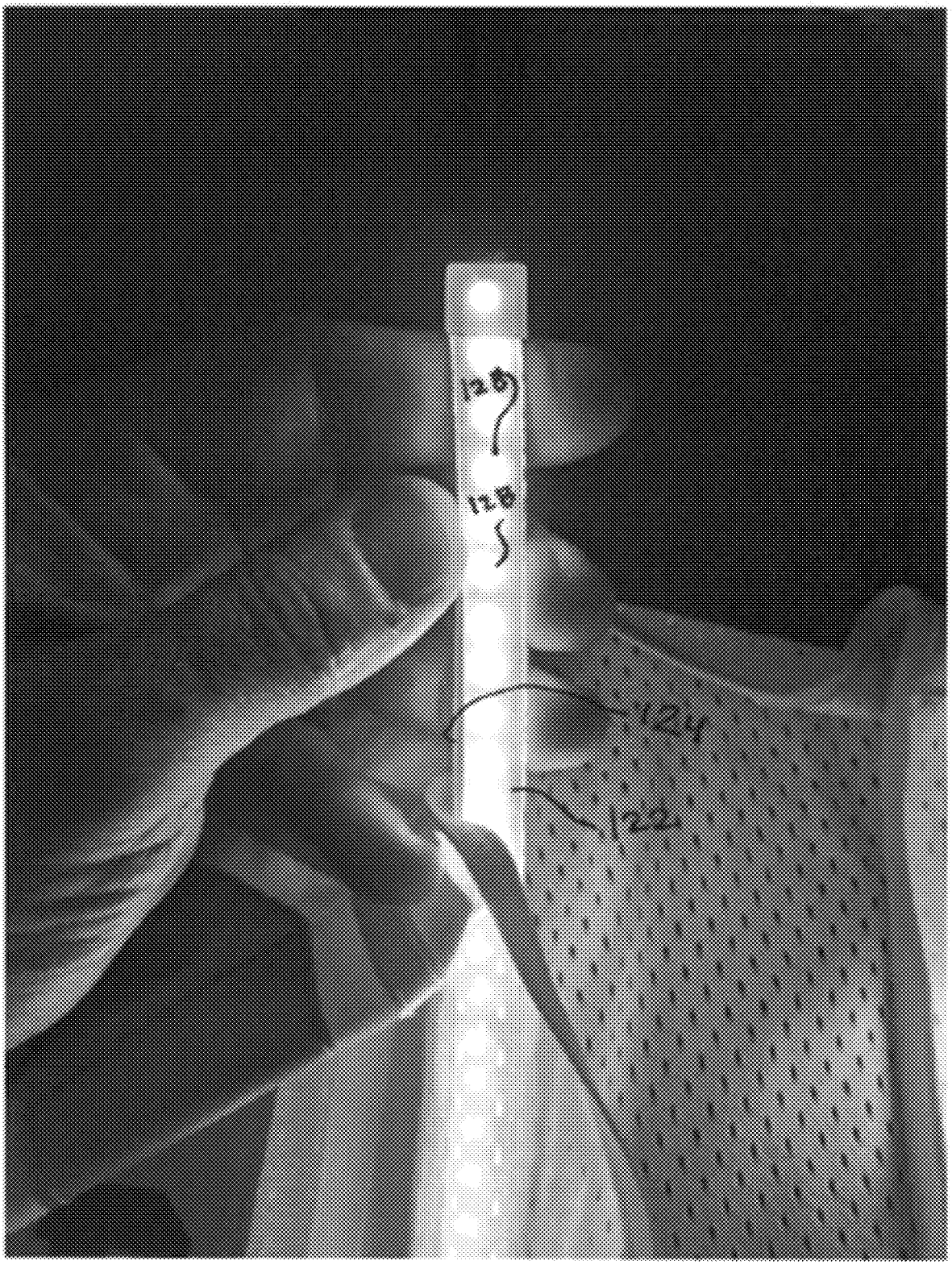
FIG. 10 depict an illuminated elongated illumination assembly that has been partially removed from a safety vest.

Referring again to FIG. 4, the elongated illumination assembly 102 can also include a cover panel 126. The cover panel 126 can be secured to the material layer 120 to create a channel between the material layer 120. The cover panel 126 can be a fabric, such as nylon, or other suitable material. The cover panel 126 can be secured to the material layer 120 using any suitable technique, such as stitching, adhesives, and so forth. The cover panel 126 and the material layer 120 can collectively define a longitudinal channel that is sized to receive the diffuser 122 and the lighting strip 124. FIG. 6 is a photograph showing example cover panels 126 stitched to the inside of an example safety vest 100. FIG. 10 is a photograph of the diffuser 122 and the lighting strip 124 that have been partially pulled from the channel for illustration purposes.

Figure 9:
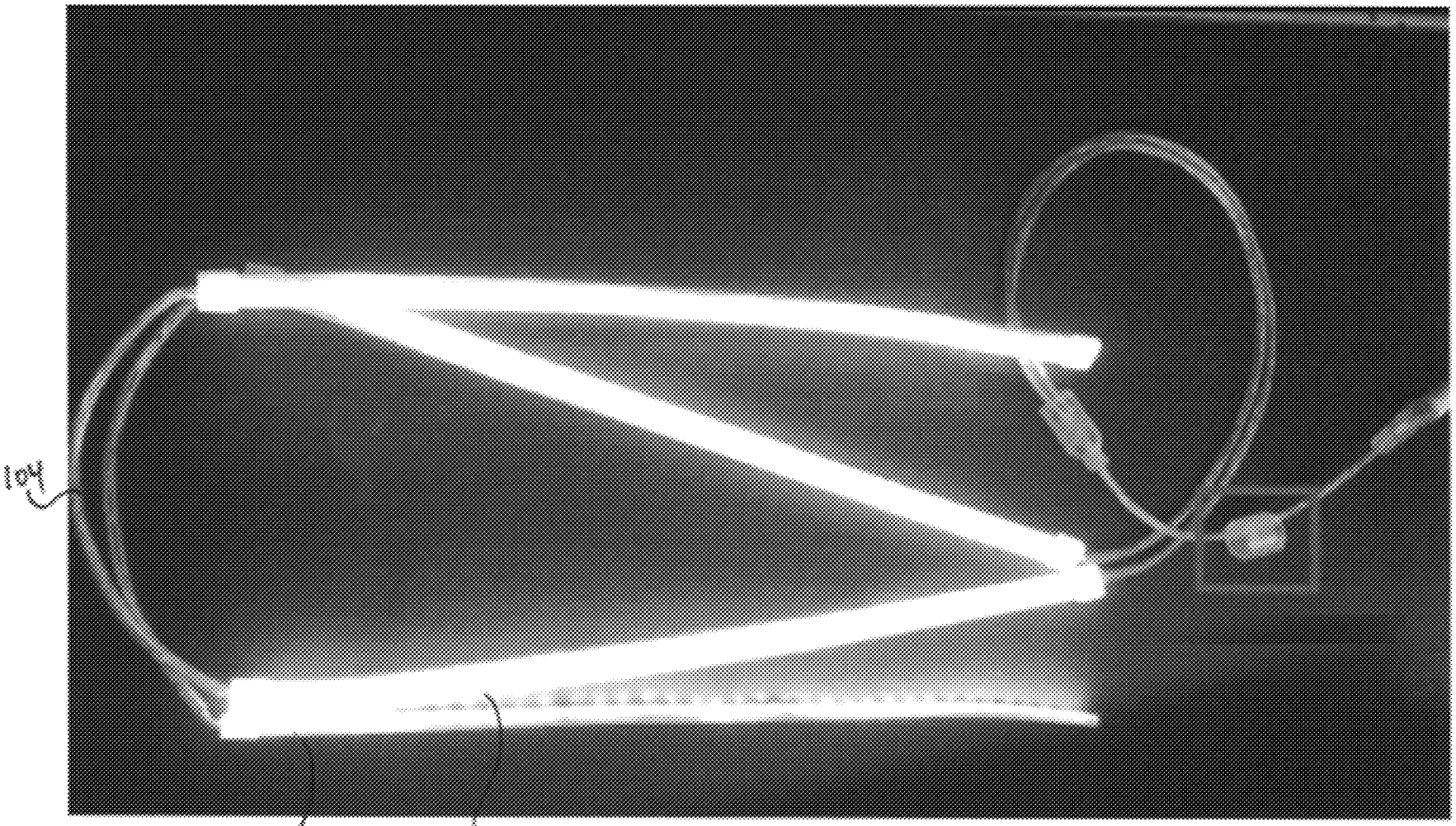
FIG. 9 depict an illuminated elongated illumination assembly that has been removed from a safety vest.
Figure 11:
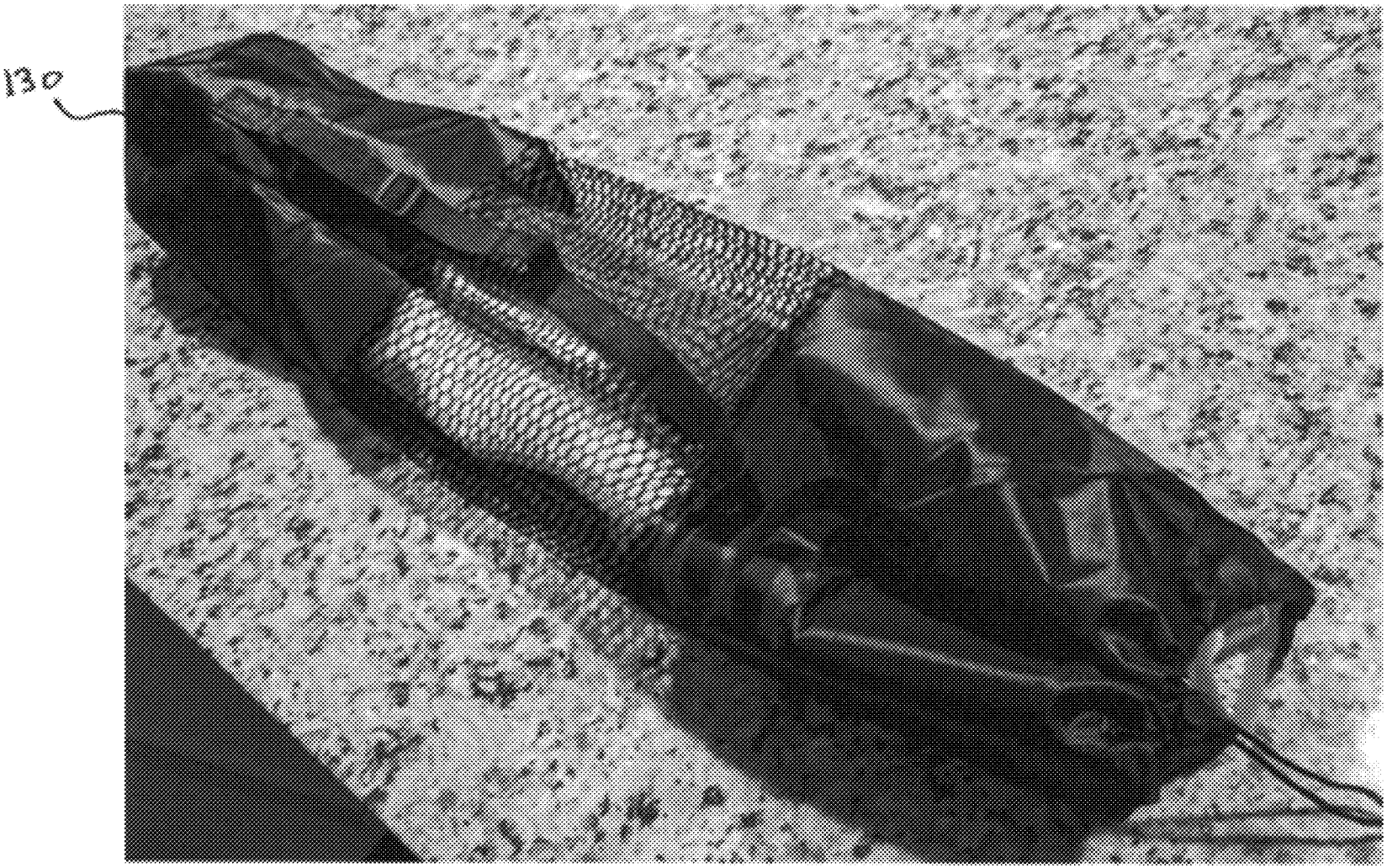
FIG. 11 depict a safety vest in a carrying case.

FIG. 9 is a photograph of illuminated elongated illumination assemblies 102 that are removed from a safety vest. The elongated illumination assemblies 102 and associated wiring 104, including any connectors, can be waterproof to allow the associated safety vest to be worn in adverse weather conditions. Further, as depicted in FIG. 11, the safety vest 100 can be easily rolled and stored in a carrying case 130.

Through the interaction of the material of the safety vest 100, the diffuser 122, and the plurality of high-intensity LEDs 128 positioned along the lighting strip 124, the elongated illumination assembly 102 can beneficially present a solid bar of bright light to an observer. By way of example, FIG. 14B is photograph of an example safety vest with the elongated illumination assemblies in a powered state and are creating a solid green bar of bright light.

Figure 12:
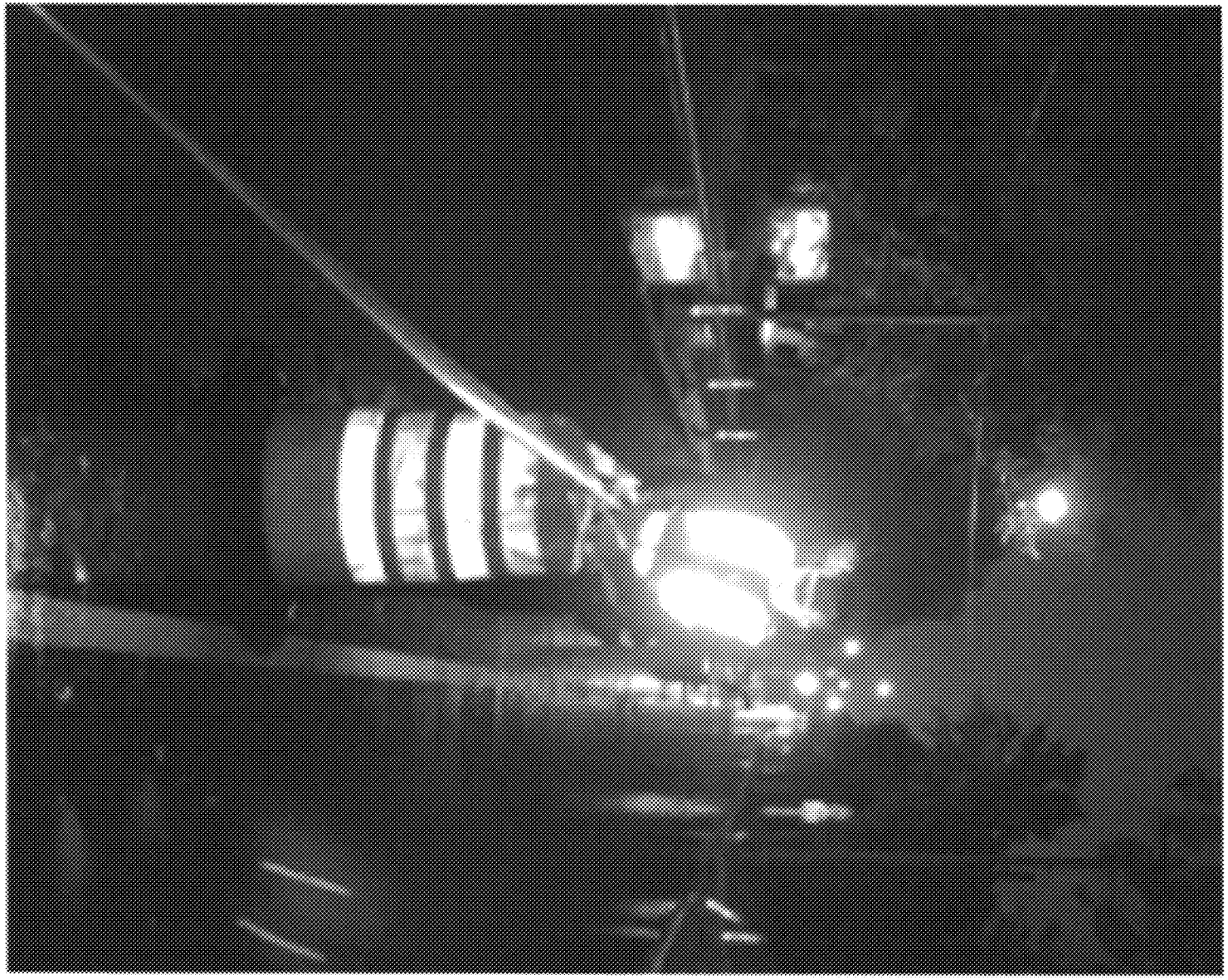
FIG. 12 depict a utility worker wearing a safety vest in accordance with the present disclosure.

FIG. 12 is a photograph of a utility worker wearing a safety vest in accordance with the present disclosure. As shown in FIG. 12, the elongated illumination assemblies of the safety vest form two continuous, vertical bands of high-intensity lighting that are highly visible to oncoming traffic, for example.

Figure 13A:
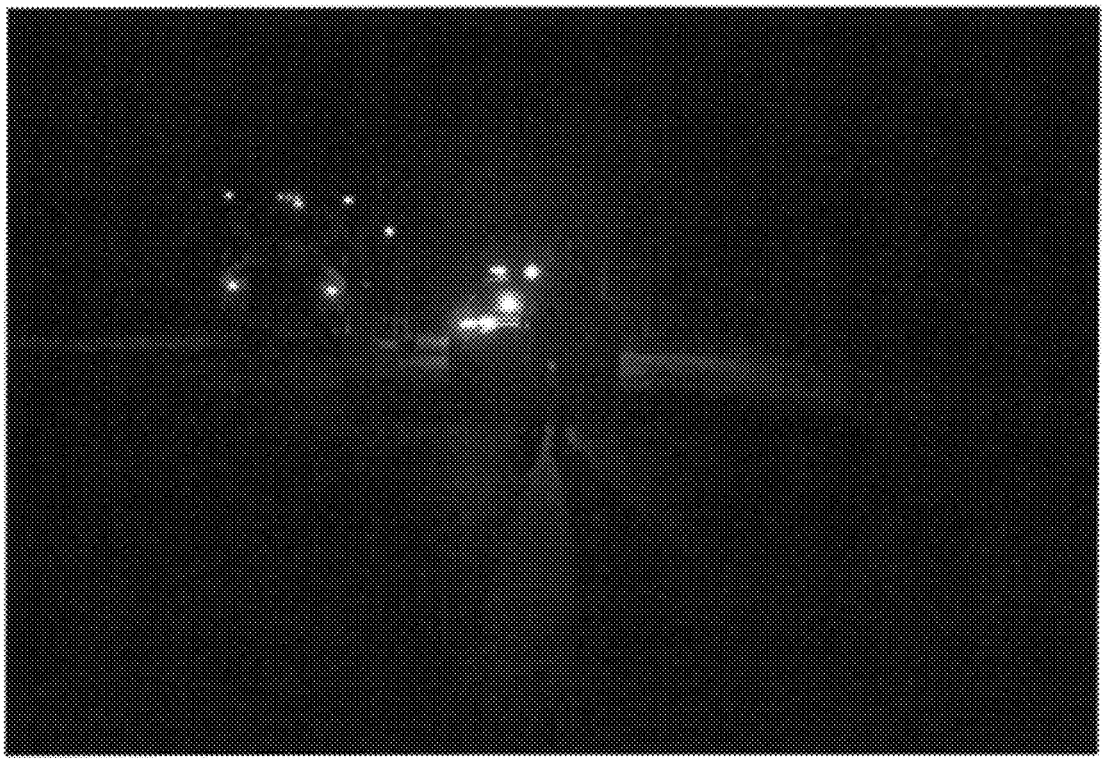
FIGS. 13A-13B depict a police officer operating proximate to safety vehicles.
Figure 13B:
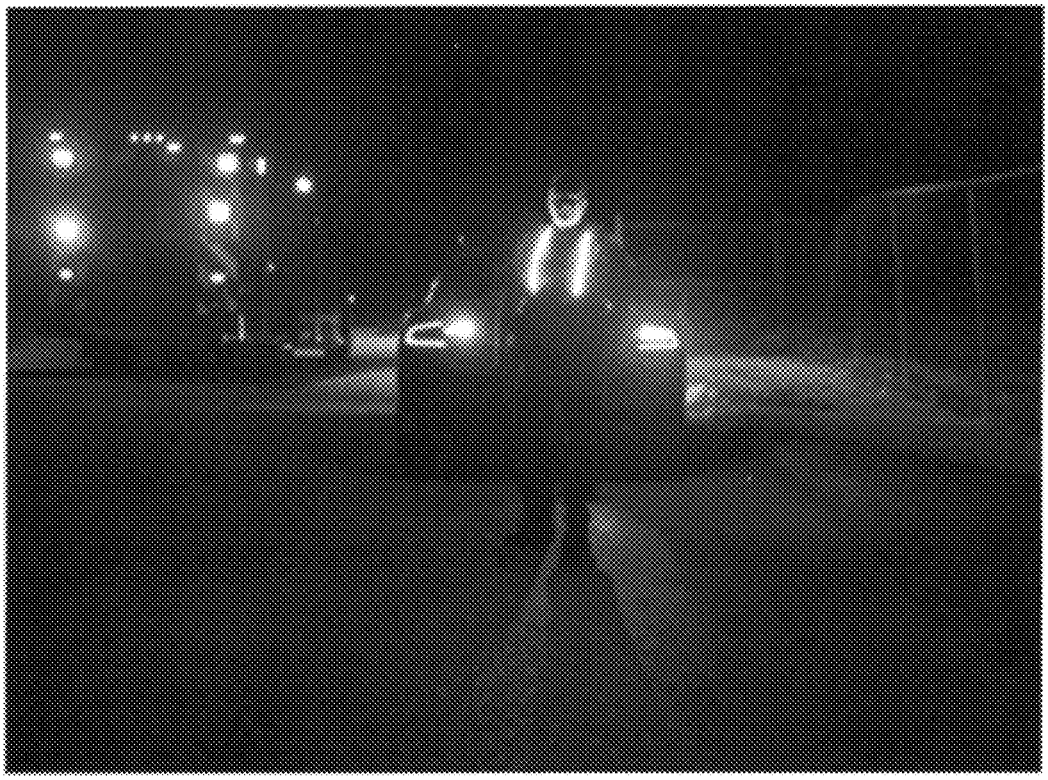

Referring now to FIGS. 13A-13B, photographs of a police officer operating proximate to safety vehicles are provided. As shown in FIG. 13A, the police officer is standing at the rear of their police vehicle, however the police officer is virtually not viewable to a person positioned to the rear of the police vehicle. By comparison, FIG. 13B is a photograph of the police officer wearing an illuminated safety vest in accordance with the present disclosure. Even in the presence of emergency lighting from other vehicles on the scene, the police officer in FIG. 13B is visible to a person positioned to the rear of the police vehicle. Beneficially, the relative position of the elongated illumination assemblies on the safety vest can reduce the amount of glare provided to the wearer, while still providing increased visibility to viewers. Moreover, when the safety vest is a green color, the hue provided by the elongated illumination assemblies can contrast with other typical emergency lighting (blue, red, and amber), which also serves to increase the visibility of the safety vest.

The dimensions and values disclosed herein are not to be understood as being strictly limited to the exact numerical values recited. Instead, unless otherwise specified, each such dimension is intended to mean both the recited value and a functionally equivalent range surrounding that value.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

The foregoing description of embodiments and examples has been presented for purposes of description. It is not intended to be exhaustive or limiting to the forms described. Numerous modifications are possible in light of the above teachings. Some of those modifications have been discussed and others will be understood by those skilled in the art. The embodiments were chosen and described for illustration of various embodiments. The scope is, of course, not limited to the examples or embodiments set forth herein, but can be employed in any number of applications and equivalent articles by those of ordinary skill in the art. Rather it is hereby intended the scope be defined by the claims appended hereto.

What is claimed is:

1. A high visibility safety vest assembly comprising:

a vest comprising a material layer;

first and second elongated illumination assemblies each being positioned on a front portion of the vest;

third and fourth elongated illumination assemblies each being positioned on a rear portion of the vest;

a power supply comprising a rechargeable battery and supported by the vest; and a control device electrically coupled with the power supply and each of the first, second, third and fourth elongated illumination assemblies, wherein the control device is configured to selectively facilitate provision of electrical power from the power supply to the first, second, third and fourth elongated illumination assemblies; wherein the first, second, third and fourth elongated illumination assemblies are positioned such that, when the vest is donned by a person standing upright, each of the first, second, third and fourth elongated illumination assemblies are generally vertically oriented; and the first, second, third and fourth elongated illumination assemblies are each mounted to an inside surface of the material layer of the vest, such that high-intensity illumination generated by the first, second, third and fourth elongated illumination assemblies is viewable through the material layer of the vest.

2. The high visibility safety vest assembly of claim 1 wherein:

the material layer is a first color;

each of the first, second, third and fourth elongated illumination assemblies are configured to emit white light; and as a result of passing through the material layer, the illumination of the first, second, third and fourth elongated illumination assemblies provides to observers a hue corresponding with the first color.

3. The high visibility safety vest assembly of claim 2 wherein the hue contrasts with other typical emergency lighting, to facilitate increased visibility of the safety vest.

4. The high visibility safety vest assembly of claim 3 wherein the hue is green.

5. The high visibility safety vest assembly of claim 1 further comprising reflective portions attached to the vest.

6. The high visibility safety vest assembly of claim 5 wherein the first, second, third and fourth elongated illumination assemblies are positioned to be generally parallel with the reflective portions.

7. The high visibility safety vest assembly of claim 1 wherein:

the vest comprises a pocket; and the power supply is at least partially disposed within the pocket.

8. The high visibility safety vest assembly of claim 1 wherein the control device is configured to facilitate selection by a person from among a plurality of different illumination settings comprising at least two of a low setting, a high setting, and a flashing setting.

9. The high visibility safety vest assembly of claim 8 wherein the control device comprises a dimmer switch.

10. The high visibility safety vest assembly of claim 1 wherein the material layer comprises a polyester mesh.

11. The high visibility safety vest assembly of claim 1 wherein each of the first, second, third and fourth elongated illumination assemblies comprises, respectively:

a lighting strip;

a plurality of LEDs attached to the lighting strip in a linear arrangement; and a diffuser configured to diffuse light generated by the plurality of LEDs.

12. The high visibility safety vest assembly of claim 11 wherein the LEDs are generally evenly spaced from one another along the lighting strip.

13. The high visibility safety vest assembly of claim 11 wherein the diffuser has a width and length that generally correspond with a width and length of the lighting strip.

14. The high visibility safety vest assembly of claim 11 wherein the LEDs are ultra-bright, high-intensity LEDs that have a light efficiency of about 120 to about 130 lm/w, a color temperature of about 6500K, and a working voltage of about 12 VDC.

15. The high visibility safety vest assembly of claim 12 wherein the lighting strip is about 11.5 inches in length, about 0.375 inches in width and supports at least 30 LEDs.

16. A The high visibility safety vest comprising:

a vest comprising a material layer;

first and second elongated illumination assemblies each being positioned on a front portion of the vest;

third and fourth elongated illumination assemblies each being positioned on a rear portion of the vest;

a power supply comprising a rechargeable battery and supported by the vest; and a control device electrically coupled with the power supply and each of the first, second, third and fourth elongated illumination assemblies, wherein the control device is configured to selectively facilitate provision of electrical power from the power supply to the first, second, third and fourth elongated illumination assemblies; wherein the first, second, third and fourth elongated illumination assemblies are positioned such that, when the vest is donned by a person standing upright, each of the first, second, third and fourth elongated illumination assemblies are generally vertically oriented; and each of the first, second, third and fourth elongated illumination assemblies comprises, respectively:

a lighting strip;

a plurality of LEDs attached to the lighting strip in a linear arrangement, with the LEDs being generally evenly spaced from one another along the lighting strip; and a diffuser configured to diffuse light generated by the plurality of LEDs;

wherein the lighting strip is about 11.5 inches in length, about 0.375 inches in width and supports a total of 36 LEDs.

17. The high visibility safety vest assembly of claim 11 wherein the diffuser is formed from polycarbonate.

18. The high visibility safety vest assembly of claim 11 being configured such that, due to close and consistent spacing of the plurality of LEDs and use of the diffuser, for each of the first, second, third and fourth elongated illumination assemblies, an observer will view a solid bar of bright light when the LEDs are illuminated.

19. The high visibility safety vest assembly of claim 1 wherein all components thereof are configured to allow prolonged operation thereof when worn in adverse weather conditions.

20. The high visibility safety vest assembly of claim 1 wherein the LEDs have a working voltage of about 12 VDC.

* * * * *